US010024004B1

(12) United States Patent
Oetken et al.

(10) Patent No.: US 10,024,004 B1
(45) Date of Patent: Jul. 17, 2018

(54) VARIABLE ECCENTRICITY VIA SLIDING MECHANISM

(71) Applicant: Caterpillar Paving Products Inc., Brooklyn Park, MN (US)

(72) Inventors: Nicholas Alan Oetken, Brooklyn Park, MN (US); Katie Lynn Goebel, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/444,560

(22) Filed: Feb. 28, 2017

(51) Int. Cl.
*E01C 19/00* (2006.01)
*E01C 19/28* (2006.01)
*B06B 1/16* (2006.01)

(52) U.S. Cl.
CPC ..... *E01C 19/286* (2013.01); *B06B 1/162* (2013.01); *E01C 19/282* (2013.01)

(58) Field of Classification Search
CPC ..... E01C 19/282; E01C 19/286; B06B 1/162
USPC ..... 404/72–85, 113, 117
See application file for complete search history.

(56) References Cited

U.S. PATENT DOCUMENTS

| | | | | |
|---|---|---|---|---|
| 4,367,054 | A * | 1/1983 | Salani | E01C 19/286 366/116 |
| 4,759,659 | A | 7/1988 | Copie | |
| 4,830,534 | A * | 5/1989 | Schmelzer | B06B 1/164 404/117 |
| 6,224,293 | B1 * | 5/2001 | Smith | B06B 1/164 404/117 |
| 6,585,450 | B2 | 7/2003 | Meyers et al. | |
| 8,393,826 | B1 | 3/2013 | Marsolek et al. | |
| 8,556,039 | B2 | 10/2013 | Marsolek et al. | |
| 9,103,077 | B2 | 8/2015 | Oetken | |
| 2011/0158745 | A1 * | 6/2011 | Oetken | E01C 19/286 404/72 |
| 2017/0306573 | A1 * | 10/2017 | Magalski | E01C 19/286 |

FOREIGN PATENT DOCUMENTS

DE 10105687 A1 10/2002

* cited by examiner

*Primary Examiner* — Raymond W Addie
(74) *Attorney, Agent, or Firm* — Miller, Matthias & Hull

(57) ABSTRACT

A vibratory mechanism may include a support housing extending between a first end and a second end and disposed along a common axis of the drum assembly, a first shaft coupled to the first end of the support housing and rotatably movable about the common axis, a second shaft coupled to the second end of the support housing and axially movable along the common axis, an eccentric mass disposed between the first shaft and the second shaft and rotatable about a travel radius, a first link pivotally coupling the eccentric mass to the first shaft, and a second link pivotally coupling the eccentric mass to the second shaft.

20 Claims, 3 Drawing Sheets

VARIABLE ECCENTRICITY VIA SLIDING MECHANISM

TECHNICAL FIELD

The present disclosure relates generally to vibratory compaction machines, and more particularly, to eccentric vibratory mechanisms and systems for compaction machines.

BACKGROUND

Compaction machines are frequently employed for compacting fresh laid asphalt, dirt, gravel, and other materials associated with laying road surfaces. One such type of compaction machine is a drum-type compactor having one or more drums adapted to compact particular materials over which the compactor is being driven. In order to compact the material, a drum-type compactor includes a drum assembly having a vibratory mechanism that typically includes multiple eccentric weights arranged about a rotatable shaft situated within a cavity of the drum. Both vibratory amplitude and frequency can be adjusted to establish a desired degree of compaction for the given type of material being compacted. In some conventional drum-type compactors for instance, the rotational speed of the eccentric weights may be adjusted to vary vibratory frequency, while the relative positions of the weights may be adjusted to vary vibratory amplitude.

While conventional vibratory mechanisms may provide adequate results, there is still room for improvement. In particular, in order to enable adjustable vibratory frequency and amplitude, conventional vibratory mechanisms commonly rely on multiple eccentric weights. However, manipulating a larger number of eccentric weights translates into larger magnitudes of inertia to overcome during operation. More specifically, more energy and/or time is typically needed to adequately startup and/or adjust the eccentric weights and achieve the desired vibratory frequency and amplitude. Furthermore, conventional systems rely a fairly complex arrangement of mechanical and/or hydraulic systems in order to drive the multiple eccentric weights and enable adjustability. Some conventional systems employ a single eccentric weight which may limit some of these adverse effects. However, these systems tend to be either limited in variability and/or dependent on rather complex mechanisms in order to provide variability.

One such example is disclosed in U.S. Pat. No. 4,759,659 ("Copie"). Copie discloses a vibratory drum compactor which uses a single eccentric weight that is movable relative to a central shaft of the drum compactor. Copie adjusts vibratory frequency by controlling the rotation of the shaft, and adjusts vibratory amplitude by controlling the position of the weight relative to the central shaft. In order to achieve this variability, however, Copie relies on an elaborate hydraulic network which pulls the weight inward when pressurized, and allows centrifugal force to extend the weight outward when not pressurized. Still further, the drum compactor in Copie is only capable of two discrete settings and thus limited in variability. More specifically, Copie operates in either a maximum vibration setting which extends the weight to its fully extended position, or a zero vibration setting which restores the weight to its fully retracted or centered position.

The present disclosure is directed at addressing one or more of the deficiencies and disadvantages set forth above. However, it should be appreciated that the solution of any particular problem is not a limitation on the scope of this disclosure or of the attached claims except to the extent expressly noted.

SUMMARY OF THE DISCLOSURE

In one aspect of the present disclosure, a vibratory mechanism for a drum assembly is provided. The vibratory mechanism may include a support housing extending between a first end and a second end and disposed along a common axis of the drum assembly, a first shaft coupled to the first end of the support housing and rotatably movable about the common axis, a second shaft coupled to the second end of the support housing and axially movable along the common axis, an eccentric mass disposed between the first shaft and the second shaft and rotatable about a travel radius, a first link pivotally coupling the eccentric mass to the first shaft, and a second link pivotally coupling the eccentric mass to the second shaft.

In another aspect of the present disclosure, a compaction machine is provided. The compaction machine may include a main frame, at least one drum assembly movably coupled to the main frame and having a support housing rotatably disposed about a common axis of the drum assembly, a first shaft rotatably movable relative to a first end of the support housing and rotatably movable about the common axis, a second shaft coupled to a second end of the support housing and axially movable along the common axis, an eccentric mass pivotally coupled to each of the first shaft and the second shaft and rotatable about a travel radius, a vibratory motor operatively coupled to the first shaft and configured to adjust a vibratory frequency of the drum assembly, and a linear actuator operatively coupled to the second shaft and configured to adjust a vibratory amplitude of the drum assembly.

In yet another aspect of the present disclosure, a method of providing variable eccentricity in a drum assembly. The method may include providing a first shaft and a second shaft disposed along a common axis of the drum assembly, providing an eccentric mass pivotally coupled between the first shaft and the second shaft and rotatable about a travel radius, adjusting a rotational speed of the first shaft to adjust a vibratory frequency of the drum assembly, and adjusting an axial position of the second shaft to adjust a vibratory amplitude of the drum assembly.

These and other aspects and features will be more readily understood when reading the following detailed description in conjunction with the accompanying drawings.

While the following detailed description is given with respect to certain illustrative embodiments, it is to be understood that such embodiments are not to be construed as limiting, but rather the present disclosure is entitled to a scope of protection consistent with all embodiments, modifications, alternative constructions, and equivalents thereto.

DETAILED DESCRIPTION

Figure 1:
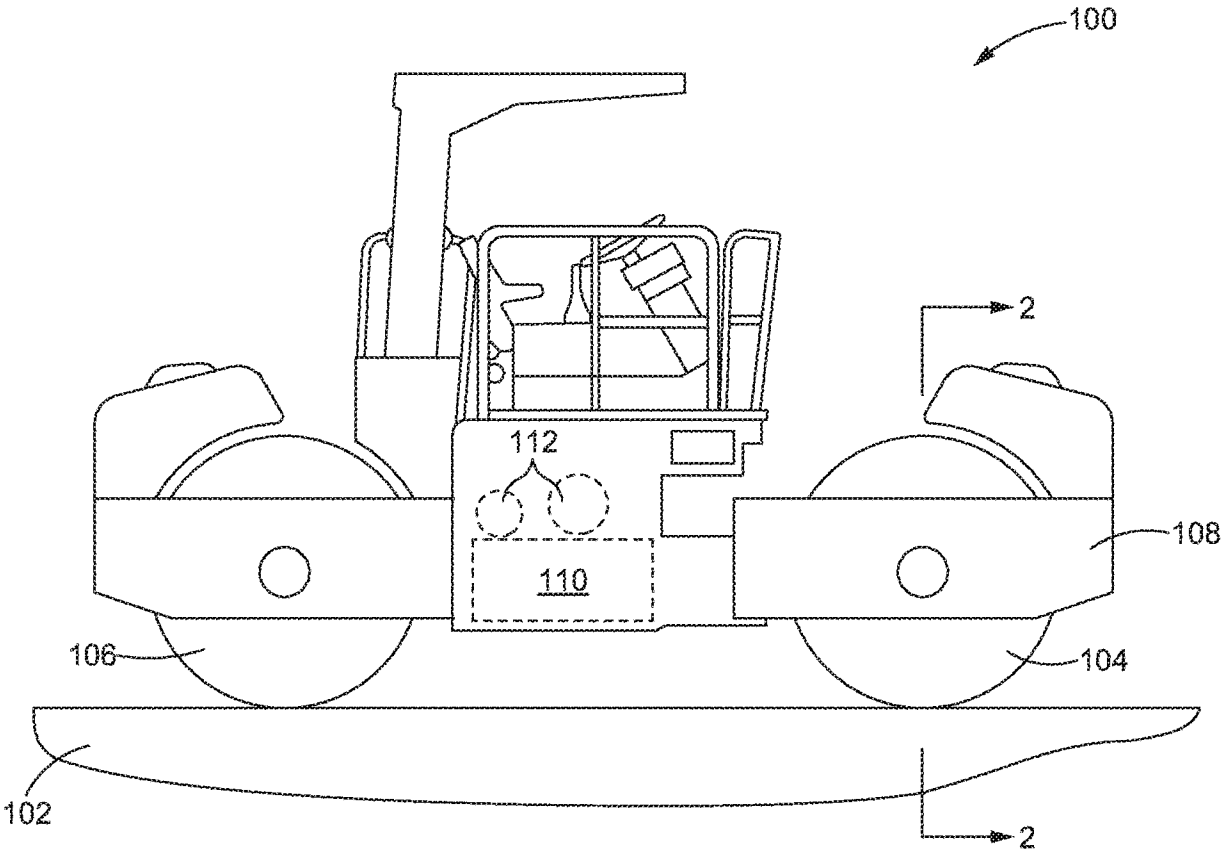
FIG. 1 is a schematic view of a compaction machine that embodies an exemplary drum assembly of the present disclosure.

Referring now to FIG. 1, one exemplary embodiment of a compactor or compaction machine 100 is provided. As shown, the compaction machine 100 may be used for compacting or increasing density of a compactable material or mat 102, such as soil, gravel, and/or bituminous mixtures. More particularly, the compaction machine 100 may include a front drum assembly 104 and a rear drum assembly 106, both of which may be movably mounted to a main frame 108 of the compaction machine 100. Although the embodiment of FIG. 1 illustrates a double vibratory drum configuration, the compaction machine 100 may alternatively employ a single vibratory drum configuration, such as a vibratory drum in either the front or the rear of the compaction machine 100, without departing from the spirit and scope of the present disclosure. In single vibratory drum configurations, conventional traction devices or other supporting devices may be used in place of the second vibratory drum to accommodate mobility of the compaction machine 100. In still further modifications, more than two vibratory drums may be provided.

Still referring to FIG. 1, the compaction machine 100 may additionally include a primary power source 110 and one or more secondary power sources 112, all of which may be supported by the main frame 108. The primary power source 110 may include a combustion engine, or the like, and the secondary power sources 112 may include electric generators, hydraulic pumps, or the like. Moreover, the primary power source 110 may be configured to supply motive power to the compaction machine 100, as well as supply operating power to one or more of the secondary power sources 112. In turn, the secondary power sources 112 may be configured to supply electric current and/or pressurized fluid to the drum assemblies 104, 106 or any other auxiliary device of the compaction machine 100. To the extent that the front drum assembly 104 and the rear drum assembly 106 may be structurally and operatively equivalent, the description of all components related thereto will be described only with respect to the front drum assembly 104. As such, all aspects of the disclosure related to the front drum assembly 104 correspondingly apply to the rear drum assembly 106.

Figure 2:
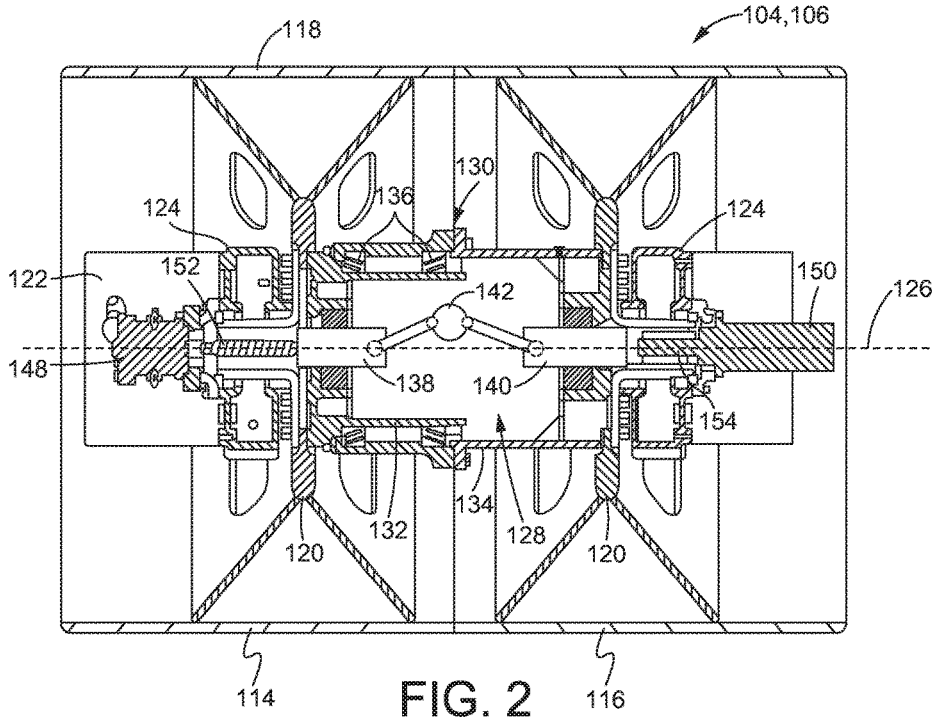
FIG. 2 is an axial cross-sectional view of the drum assembly of FIG. 1 showing an exemplary vibratory mechanism of the present disclosure.

Turning to FIG. 2, one exemplary embodiment of the front drum assembly 104 is provided. In its most basic form, the drum assembly 104 may be constructed as a single-piece cylindrical drum. In other variations, the drum assembly 104 may be sectional. As shown in FIG. 2 for instance, the front drum assembly 104 may include a first or left drum section 114 and a second or right drum section 116. The first drum section 114 may be separated from the second drum section 116 to enable speed differentials therebetween and facilitate mobility of the compaction machine 100 during turns. For instance, the drum section 114, 116 with a shorter turn radius may be allowed to rotate at a slower rotational speed than the counterpart drum section 114, 116 with a longer turn radius. Such differential action reduces the tendency for scuffing, tearing, or otherwise damaging the mat 102. Furthermore, each of the first drum section 114 and the second drum section 116 may generally be constructed of an outer shell 118 and a bulkhead 120 that is rigidly secured to the inner surface of the respective outer shell 118. While only one arrangement is presented, other suitable arrangements are also possible and will be apparent to those of ordinary skill in the art.

With reference to FIG. 2, the front drum assembly 104 may additionally include one or more propel motors 122 that are secured to the main frame 108 and positioned between the main frame 108 and each of the first drum section 114 and the second drum section 116. The mechanical output or rotational torque supplied by the propel motors 122 may be used to drive the respective bulkheads 120 and rotate the corresponding drum sections 114, 116. Furthermore, the propel motors 122 may be operated by electric current and/or pressurized fluid supplied by one or more of the secondary power sources 112 noted above. The propel motors 122 may be coupled to the bulkheads 120 through a set of offset gearboxes 124, which allow the propel motors 122 to be slightly offset from a common axis 126 of the drum assembly 104. Alternatively, in other mounting arrangements, the offset gearboxes 124 may be omitted and the propel motors 122 may be coupled directly to the bulkheads 120. In still further modifications, a single propel motor 122 may be used to drive two independent gearboxes 124 to simultaneously drive both of the bulkheads 120 at different speeds.

Still referring to FIG. 2, the drum assembly 104 may also include a vibratory mechanism 128 and a support housing 130 for supporting the vibratory mechanism 128 within the drum assembly 104. Specifically, the support housing 130 may be coupled to the bulkheads 120 and structured to house the vibratory mechanism 128 along the common axis 126 of the drum assembly 104. Additionally, the support housing 130 may be designed to accommodate for any speed differentials between the first drum section 114 and the second drum section 116. As shown in FIG. 2 for example, the support housing 130 may include an inner support member 132 that is coupled to the left drum section 114, and an outer support member 134 that is coupled to the right drum section 116. The inner support member 132 may be coupled to, but allowed to rotate relative to, the outer support member 134, such as by way of support bearings 136, or the like, which enable the respective drum sections 114, 116 to rotate relative to one another in accordance with the differential actions noted above.

While only one arrangement for the support housing 130 is shown, other suitable arrangements are also possible and will be apparent to those of skill in the art. For instance, while the support housing 130 is shown as a separate body from the drum assembly 104, in other arrangements, the support housing 130 may be integrated within the drum assembly 104, defined by inner surfaces of the drum assembly 104, or the like. Furthermore, although the drawings depict sectional drum assemblies 104 having first and second drum sections 114, 116, the foregoing embodiments may also be implemented in single-piece drum assemblies 104 constructed using solid cylindrical bodies. Similar to the sectional arrangements shown in FIGS. 2 and 3, the support housing 130 in a single-piece arrangement may be provided separate from the drum assembly 104, or defined by the inner surfaces of the drum assembly 104.

Figure 3:
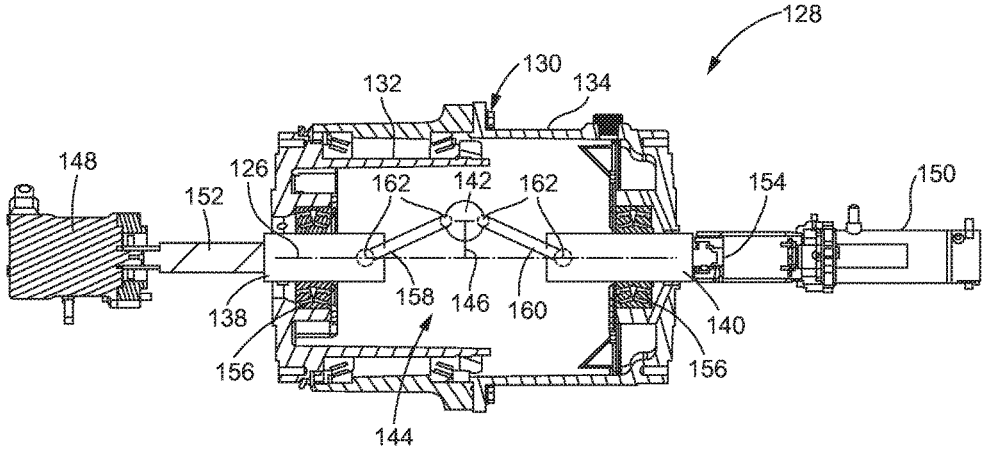
FIG. 3 is an axial cross-sectional view of the vibratory mechanism of FIG. 2 providing variable eccentricity using a sliding mechanism.

Referring now to FIG. 3, one exemplary embodiment of the vibratory mechanism 128 is provided in more detail. As shown, the vibratory mechanism 128 may generally include a first shaft 138 that is rotatably disposed along the common axis 126, a second shaft 140 that is axially movable along the common axis 126, and a single eccentric mass 142 pivotally coupled between the first shaft 138 and the second shaft 140. Moreover, the vibratory mechanism 128 may further include a link assembly 144 configured to pivotally couple the eccentric mass 142 to each of the first shaft 138 and the second shaft 140. The link assembly 144 may be designed to separate the eccentric mass 142 from the common axis 126 by an adjustable travel radius 146. In addition, the vibratory mechanism 128 may also include a vibratory motor 148 that is operatively coupled to the first shaft 138 and configured to adjust the effective vibratory frequency of the eccentric mass 142, and a linear actuator 150 that is operatively coupled to the second shaft 140 and configured to adjust an effective vibratory amplitude of the eccentric mass 142.

According to the embodiment shown in FIG. 3, for example, the vibratory motor 148 may be rigidly coupled to the first shaft 138 via a driveshaft 152, or the like. Through the driveshaft 152, the vibratory motor 148 may rotate the first shaft 138 about the common axis 126 at a rotational speed that approximates or is otherwise proportional to the rotational speed of the vibratory motor 148. The linear actuator 150 may be coupled to the second shaft 140 via a pneumatically actuatable cylinder rod 154, or the like, and configured to axially extend or retract the second shaft 140 along the common axis 126. In particular, the linear actuator 150 may slidably adjust the axial position of the second shaft 140 relative to the support housing 130 and the first shaft 138. Furthermore, each of the first shaft 138 and the second shaft 140 may be rotatably mounted to the support housing 130 via shaft bearings 156, or the like, which enable the support housing 130 and the respective drum sections 114, 116 to rotate independently of the vibratory mechanism 128 and/or the first and second shafts 138, 140 thereof during operation.

Still referring to FIG. 3, the link assembly 144 may include at least a first link 158 that pivotally couples the first shaft 138 to the eccentric mass 142, and a second link 160 that pivotally couples the second shaft 140 to the eccentric mass 142. The first link 158 may be coupled to each of the eccentric mass 142 and the first shaft 138 via one or more joints 162 which enable the first link 158 to pivot relative to one or both of the eccentric mass 142 and the first shaft 138, while also allowing rotational torque to be communicated therebetween. Similarly, the second link 160 may also be coupled to each of the eccentric mass 142 and the second shaft 140 via one or more joints 162 which enable the second link 160 to pivot relative to one or both of the eccentric mass 142 and the second shaft 140. For example, each joint 162 may be a hinge joint, or any other comparable connection that allows the eccentric mass 142 to be removed from the common axis 126, while also allowing the first shaft 138 to rotate the eccentric mass 142 about the common axis 126 at a desired speed. Other types of joints 162, such as ball joints, or the like, may be employed at the ends of the second link 140 since rotational torque need not be communicated through the eccentric mass 142 and to the second shaft 140.

Although four possible locations for the joints 162 are depicted in FIGS. 2 and 3, the phantom lines serve to indicate that not all four joints 162 and/or locations for the joints 162 are necessary. In one possible arrangement, for example, the first link 158 may be pivotally coupled to the first shaft 138 but fixedly coupled to the eccentric mass 142, thereby needing only one joint 162 where the first link 158 meets the first shaft 138. Correspondingly, the second link 160 may be pivotally coupled to each of the eccentric mass 142 and the second shaft 140, thereby needing one joint 162 at each end of the second link 160. In an alternate arrangement, the second link 160 may be fixedly coupled to the eccentric mass 142 and pivotally coupled to the second shaft 140, thereby needing only one joint 162 where the second link 160 meets the second shaft 140. Correspondingly, the first link 158 may be pivotally coupled to each of the first shaft 138 and the eccentric mass 142, thereby needing one joint 162 at each end of the first link 158. In still further alternatives, a joint 162 may be provided at each of the four locations shown in FIGS. 2 and 3.

As shown, the link assembly 144 of FIG. 3 may be configured such that the rotational speed of the first shaft 138 defines the vibratory frequency of the vibratory mechanism 128. More specifically, the vibratory motor 148 rotates the first shaft 138 via the driveshaft 152, which further rotates the first link 158 and the eccentric mass 142 about the common axis 126. As long as the eccentric mass 142, or the net weight thereof, is removed to some non-zero travel radius 146, rotating the eccentric mass 142 about the common axis 126 will generate centrifugal forces that can effectuate vibratory frequencies of the vibratory mechanism 128. Thus, an adjustment of the rotational output speed of the vibratory motor 148 enables an adjustment of the vibratory frequency. Specifically, increasing the rotational speed of the first shaft 138 about the common axis 126 may increase the effective vibratory frequency, and decreasing the rotational speed of the first shaft 138 may decrease the effective vibratory frequency.

In addition, the link assembly 144 of FIG. 3 may be configured such that the axial displacement of the second shaft 140 defines the vibratory amplitude. Specifically, the linear actuator 150 controls the axial position of the second shaft 140 via the cylinder rod 154, which further controls the travel radius 146 of the eccentric mass 142. As shown, the travel radius 146 may be defined by the lengths of the first and second links 158, 160 and the physical size of the eccentric mass 142, and constrained by the radial clearance within the support housing 130 and the distance between first and second shafts 138, 140. Moreover, the link assembly 144 may be configured such that changes in the travel radius 146 are proportional to changes in the centrifugal force and the resulting vibratory amplitude. Thus, an adjustment of the axial position of the second shaft 140 enables an adjustment of the vibratory amplitude. For example, extending the second shaft 140 toward the first shaft 138 may increase the travel radius 146 and the effective vibratory amplitude, and retracting the second shaft 140 away from the first shaft 138 may decrease the travel radius 146 and the effective vibratory amplitude.

INDUSTRIAL APPLICABILITY

In general, the present disclosure sets forth eccentric vibratory mechanisms and systems for compaction machines applicable to various industrial applications related to paving and laying roads or other surfaces. For example, the present disclosure may be implemented in compaction machines commonly used for compacting fresh laid asphalt, dirt, gravel, and other materials. The present disclosure may also find utility in any other application that may benefit from having adjustable eccentricity with reduced delays and improved efficiency. In particular, the present disclosure provides a vibratory arrangement that enables fully adjustable vibratory frequency and amplitude using only a single eccentric mass. By reducing the number of eccentric masses employed, and by reducing the overall weight being manipulated, the present disclosure is able to reduce the additional time and energy typically seen in conventional startup and/or mode changes. Furthermore, the present disclosure provides a simplified link assembly that is not only fully adjustable using conventional motors and linear actuators, but also reduces costs of implementation and improves reliability.

Figure 4:
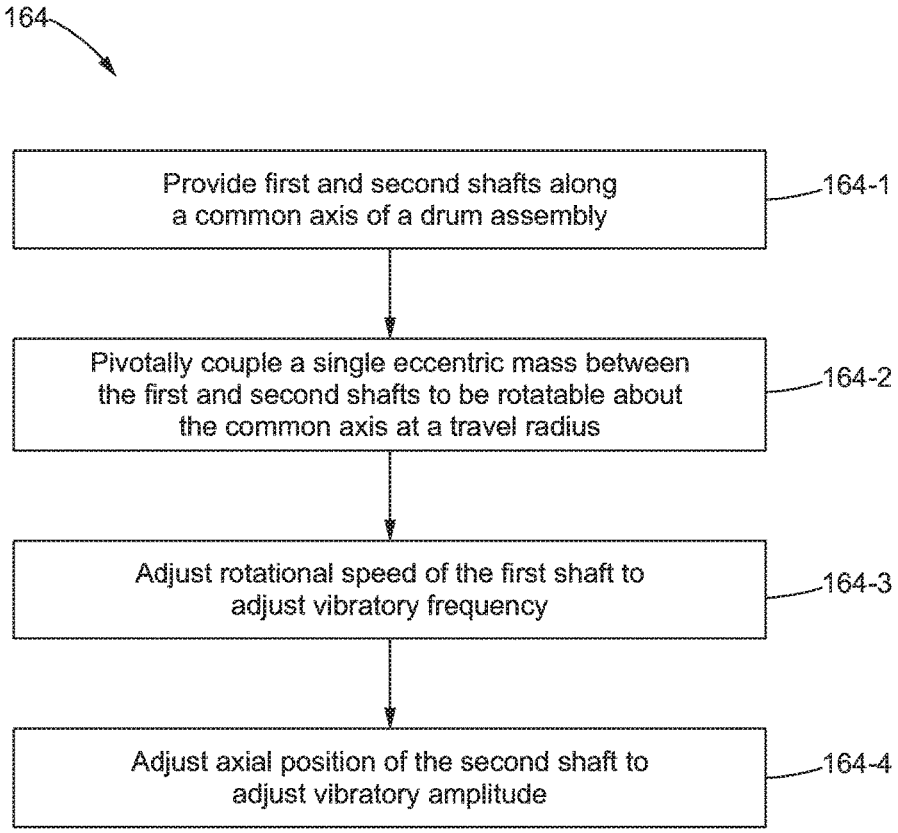
FIG. 4 is a flow diagram of an exemplary method of providing variable eccentricity in a drum assembly.

Turning now to FIG. 4, one exemplary method 164 of providing variable eccentricity in a drum assembly 104, 106 is provided. As shown, the method 164 in block 164-1 may initially provide a provide a first shaft 138 and a second shaft 140 along a common axis 126 of a drum assembly 104, 106. With reference to FIG. 2 for example, each of the first shaft 138 and the second shaft 140 may be rotatably supported within a support housing 130 that is further coupled to an outer shell 118 of the drum assembly 104, 106 via bulkheads 120, or any other comparable supporting structure. In addition, the method 164 in block 164-2 may pivotally couple a single eccentric mass 142 between the first shaft 138 and the second shaft 140 in a manner which enables the eccentric mass 142 to be rotatable about the common axis 126 of the drum assembly 104, 106. In particular, the eccentric mass 142 may be coupled to each of the first and second shafts 138, 140 via a link assembly 144 as discussed with respect to FIGS. 2 and 3. Moreover, eccentric mass 142 may be allowed to rotate about a variable travel radius 146 that is defined by the link assembly 144 and the second shaft 140.

As shown in FIG. 4, the method 164 may also be used to vary the eccentricity of the drum assembly 104, 106. Specifically, according to block 164-3, the method 164 may adjust the rotational speed of the first shaft 138 to adjust the vibratory frequency of the drum assembly 104, 106. With reference to FIGS. 2 and 3 for example, the first shaft 138 may be rotated about the common axis 126 at a speed that is adjusted via control of a vibratory motor 148 coupled thereto. Moreover, the link assembly 144 is arranged such that rotation of the first shaft 138 enables a corresponding rotation of the eccentric mass 142 about the common axis 126. The method 164 in block 164-4 may further adjust the axial position of the second shaft 140 to adjust the vibratory amplitude of the drum assembly 104, 106. With reference again to FIGS. 2 and 3, the second shaft 140 may be axially displaced along the common axis 126 relative to the first shaft 138 via control of a linear actuator 150 coupled thereto. The link assembly 144 may also be arranged such that axially displacing the second shaft 140 adjusts the travel radius 146 of the eccentric mass 142, which thereby adjusts the effective vibratory amplitude of the drum assembly 104, 106.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A vibratory mechanism for a drum assembly, the vibratory mechanism comprising:

a support housing extending between a first end and a second end and disposed along a common axis of the drum assembly;

a first shaft coupled to the first end of the support housing and rotatably movable about the common axis;

a second shaft coupled to the second end of the support housing and axially movable along the common axis;

an eccentric mass disposed between the first shaft and the second shaft and rotatable about a travel radius;

a first link pivotally coupling the eccentric mass to the first shaft; and a second link pivotally coupling the eccentric mass to the second shaft.

2. The vibratory mechanism of claim 1, further comprising support bearings coupling each of the first shaft and the second shaft to the support housing, the support bearings enabling each of the first shaft and the second shaft to rotate about the common axis relative to the support housing.

3. The vibratory mechanism of claim 1, wherein the first link is pivotally coupled between the first shaft and the eccentric mass via one or more hinge joints, the hinge joints enabling the first link to pivot relative to one or both of the first shaft and the eccentric mass, and communicating a rotational torque of the first shaft to the eccentric mass.

4. The vibratory mechanism of claim 1, wherein a rotational speed of the eccentric mass is determined based on a rotational speed of the first shaft, and the travel radius of the eccentric mass is determined based on an axial position of the second shaft.

5. The vibratory mechanism of claim 4, wherein the first link is configured to rotate the eccentric mass about the common axis according to the rotational speed of the first shaft and effectuate a vibratory frequency of the drum assembly based on the rotational speed.

6. The vibratory mechanism of claim 4, wherein the second link is configured to adjust the travel radius of the eccentric mass and effectuate a vibratory amplitude of the drum assembly based on the axial position of the second shaft.

7. The vibratory mechanism of claim 4, wherein the vibratory frequency is increased by increasing the rotational speed of the first shaft and decreased by decreasing the rotational speed of the first shaft, and the vibratory amplitude is increased by axially extending the second shaft toward the first shaft and decreased by axially retracting the second shaft away from the first shaft.

8. A compaction machine, comprising:

a main frame;

at least one drum assembly movably coupled to the main frame and having a support housing rotatably disposed about a common axis of the drum assembly;

a first shaft rotatably movable relative to a first end of the support housing and rotatably movable about the common axis;

a second shaft coupled to a second end of the support housing and axially movable along the common axis;

an eccentric mass pivotally coupled to each of the first shaft and the second shaft and rotatable about a travel radius;

a vibratory motor operatively coupled to the first shaft and configured to adjust a vibratory frequency of the drum assembly; and a linear actuator operatively coupled to the second shaft and configured to adjust a vibratory amplitude of the drum assembly.

9. The compaction machine of claim 8, wherein the eccentric mass is coupled to each of the first shaft and the second shaft via a link assembly configured to enable torque transfer between the first shaft and the eccentric mass while allowing the eccentric mass to rotate about the common axis.

10. The compaction machine of claim 9, wherein the link assembly includes a first link pivotally coupling the eccentric mass to the first shaft and a second link pivotally coupling the eccentric mass to the second shaft.

11. The compaction machine of claim 9, wherein the link assembly includes a first link configured to rotate the eccentric mass about the common axis according to a rotational speed of the first shaft to effectuate the vibratory frequency.

12. The compaction machine of claim 9, wherein the link assembly includes a second link configured to adjust the travel radius according to the axial position of the second shaft to effectuate the vibratory amplitude.

13. The compaction machine of claim 8, wherein the vibratory motor is configured to increase the vibratory frequency by increasing a rotational speed of the first shaft and decrease the vibratory frequency by decreasing the rotational speed of the first shaft.

14. The compaction machine of claim 8, wherein the linear actuator is configured to increase the vibratory amplitude by axially extending the second shaft toward the first shaft and decrease the vibratory amplitude by axially retracting the second shaft away from the first shaft.

15. The compaction machine of claim 8, wherein the vibratory motor is coupled to the first shaft via a driveshaft, and the linear actuator includes a cylinder rod that is coupled to the second shaft.

16. A method of providing variable eccentricity in a drum assembly, the method comprising:

providing a first shaft and a second shaft disposed along a common axis of the drum assembly;

providing an eccentric mass pivotally coupled between the first shaft and the second shaft and rotatable about a travel radius;

adjusting a rotational speed of the first shaft to adjust a vibratory frequency of the drum assembly; and adjusting an axial position of the second shaft to adjust a vibratory amplitude of the drum assembly.

17. The method of claim 16, wherein the eccentric mass is rotated about the common axis according to the rotational speed of the first shaft relative to the drum assembly to effectuate the vibratory frequency, and the travel radius of the eccentric mass is adjusted according to the axial position of the second shaft relative to the first shaft to effectuate the vibratory amplitude.

18. The method of claim 16, wherein the vibratory frequency is increased by increasing the rotational speed of the first shaft and decreased by decreasing the rotational speed of the first shaft.

19. The method of claim 16, wherein the vibratory amplitude is increased by axially extending the second shaft toward the first shaft and decreased by axially retracting the second shaft away from the first shaft.

20. The method of claim 16, wherein the rotational speed of the first shaft is adjusted via a vibratory motor operatively coupled thereto, and the axial position of the second shaft is adjusted via a linear actuator operative coupled thereto.

* * * * *